United States Patent [19]

Perl

[11] 4,005,697

[45] Feb. 1, 1977

[54] GAS COOK TOP

[75] Inventor: Richard L. Perl, Mansfield, Ohio

[73] Assignee: The Tappan Company, Mansfield, Ohio

[22] Filed: Feb. 9, 1976

[21] Appl. No.: 656,540

[52] U.S. Cl. ..... 126/39 E; 219/270; 431/189

[51] Int. Cl.[2] ..... F24C 3/00

[58] Field of Search ..... 126/39 E, 39 R; 431/189

[56] References Cited

UNITED STATES PATENTS

| | | | |
|---|---|---|---|
| 2,619,952 | 12/1952 | Hardy et al. | 126/39 E |
| 3,963,411 | 6/1976 | Challet | 126/39 E |

*Primary Examiner*—Edward G. Favors
*Assistant Examiner*—Robert J. Charuat
*Attorney, Agent, or Firm*—Donnelly, Maky, Renner & Otto

[57] ABSTRACT

A gas cook top having plural burners and an electric ignition system in which a single glow coil ignites a pilot at the end of a rotating tube. The tube sweeps successively by the coil and the burners to produce the pilot flame and apply the same to ignite the burner or burners turned on for use. Igniter energization and pilot rotation is responsive to and coincident with any burner on condition, with burner valve actuation controlling the coil, tube drive, and a pilot valve for the latter.

28 Claims, 11 Drawing Figures

FIG. 1
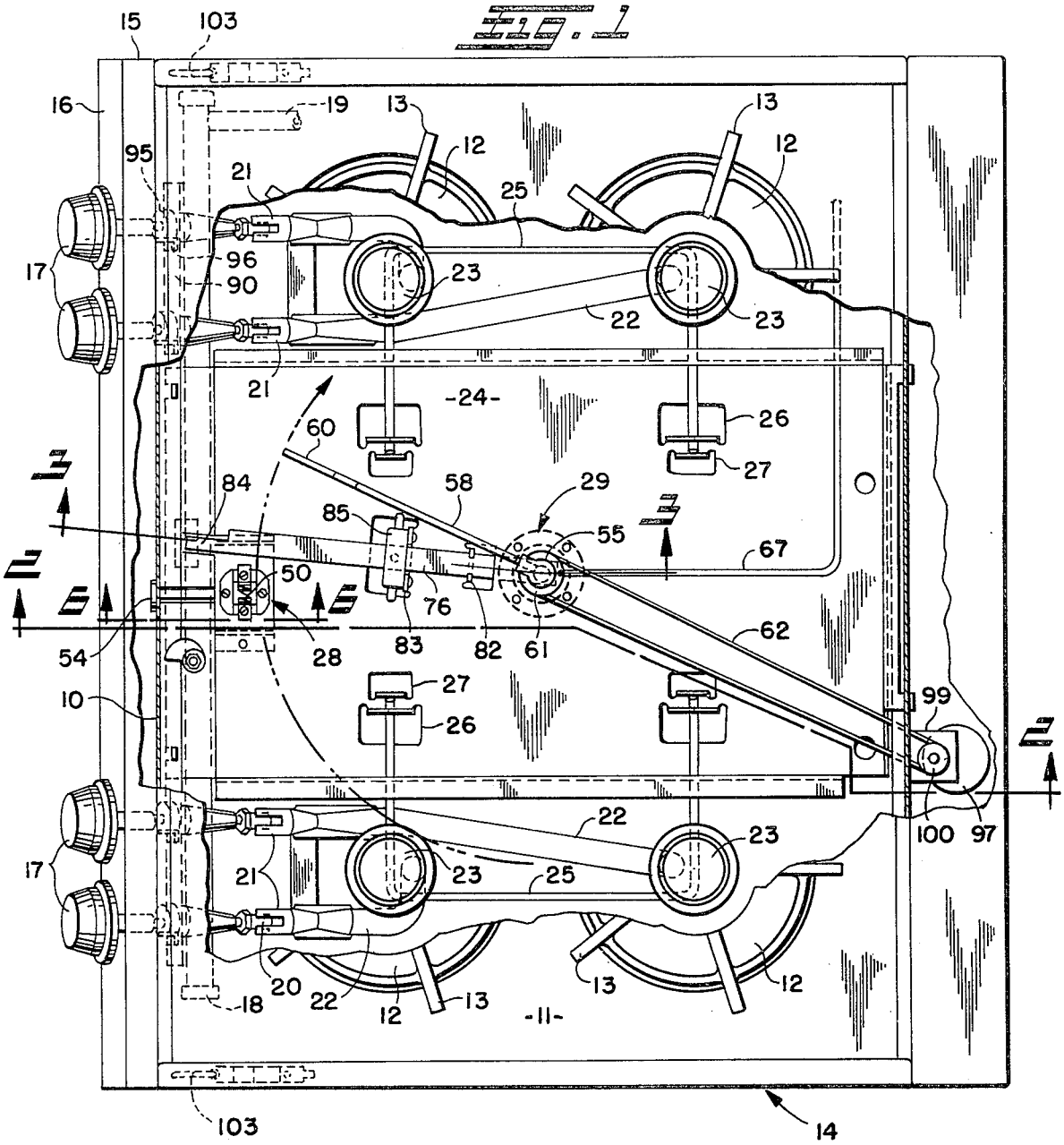
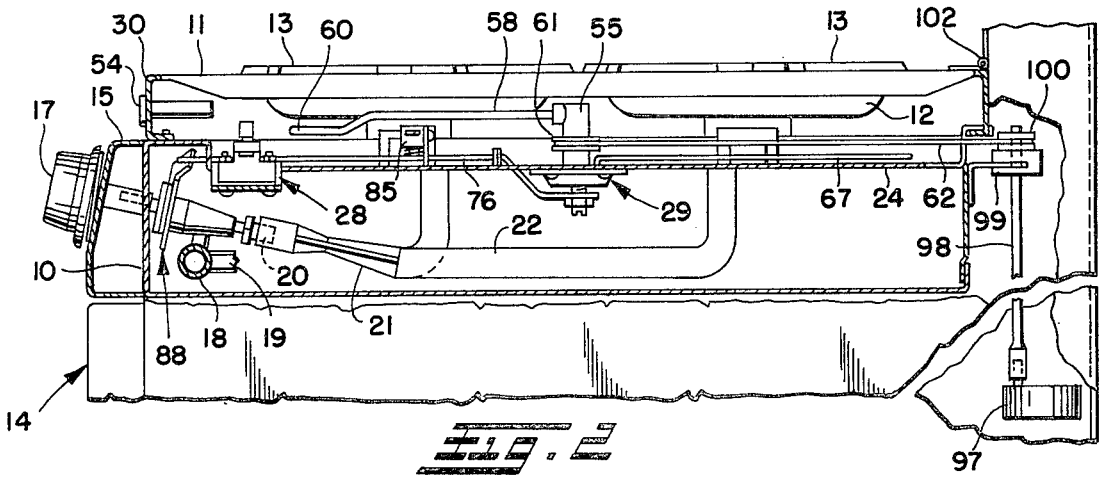
FIG. 2

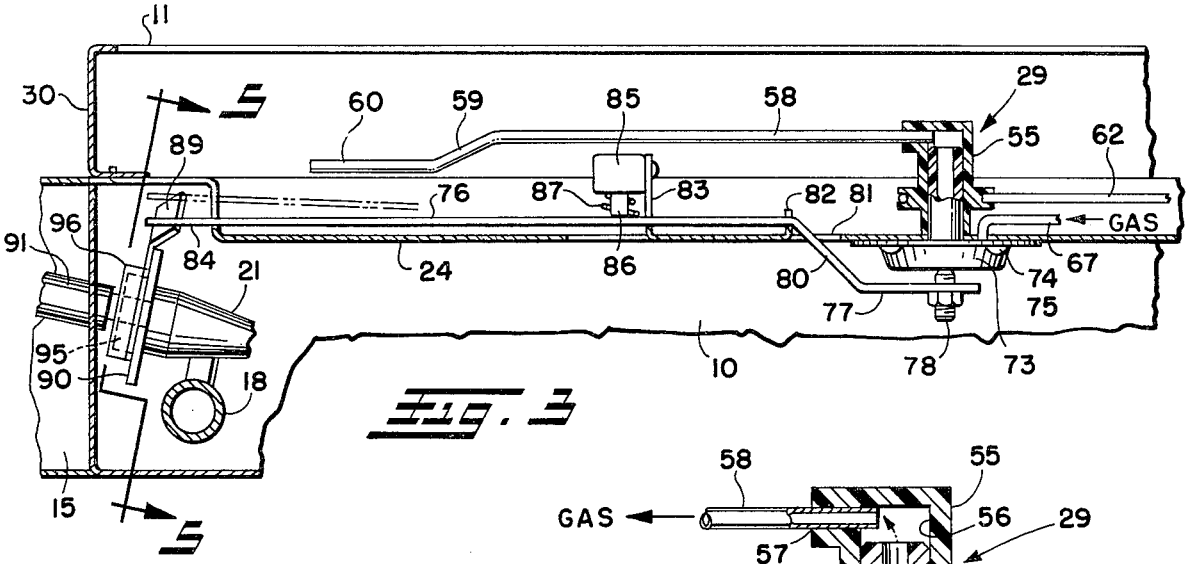
Fig. 3
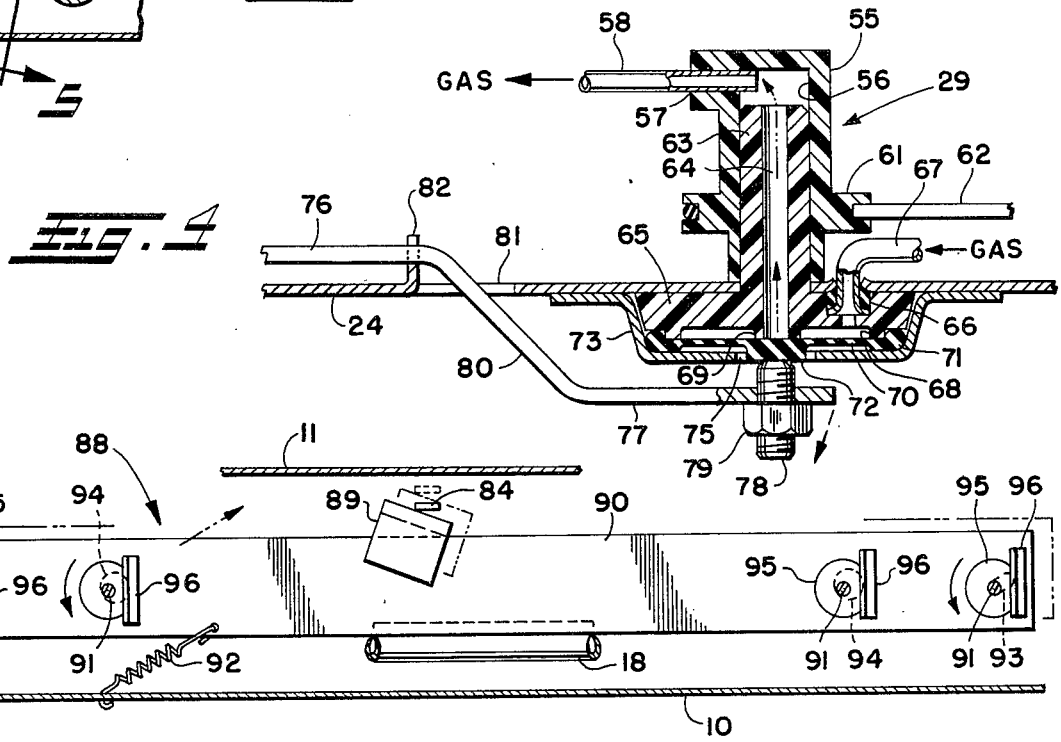
Fig. 4
Fig. 5
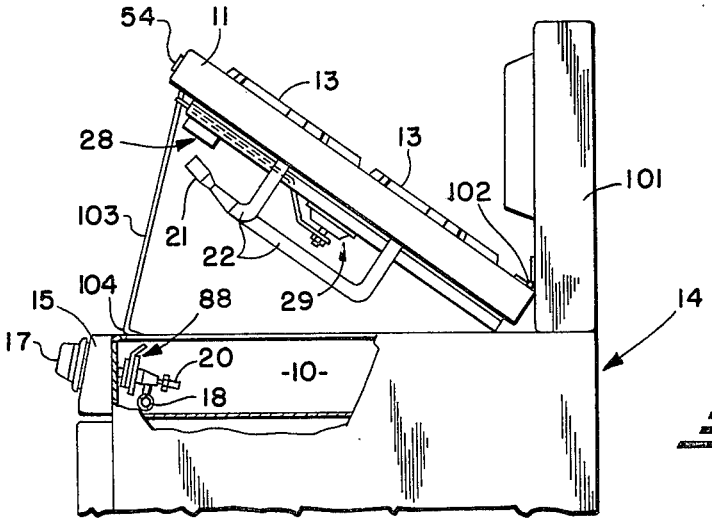
Fig. 11

GAS COOK TOP

This invention relates as indicated to a gas cook top comprising a plurality of gas burners exposed for cooking thereover in pots, pans and the like and, more particularly, to the ignition system for the burners in such assembly.

It has been recognized in the art that the constant burning gas pilots in long common use for such burner ignition present now currently emphasized questions of energy conservation and environmental influence, and that alternate ignition systems free of objection on such accounts should be considered. An obvious alternate, especially in single burner evaluation, is to employ some type of electrical ignition for readily controllable use or demand energization to directly or indirectly ignite each burner, and several proposals on this order have been made and implemented. Electric igniters, regardless of type, are comparatively expensive and the cost increased obviously in any cook top ignition system requiring more than one, with potential further premium in any circuit switching functions for selective energization and the like in the control. Such added costs of production unavoidably mean higher prices to purchasers and clearly should be minimized on such account if the criteria of reduced gas fuel consumption and environmental acceptance in particular are to be acceptably realized.

It is, therefore, a principal object of the present invention to provide an electric ignition system for a plurality of gas burners in which a single igniter will provide individual or conjoint operation of the burners as an incident of their user selection for actual use. Any cook top ignition system must meet performance standards in such respects as safety, reliability and long life to name a few, and this invention fully satisfies all such desiderata and requirements in its components and their operative combination.

Another object of the invention is the utilization of a single pilot gas line to ignite or light plural spaced burners in a cook top as selected for use cooperably with a single electric igniter. Such objective is provided by relative movement of the igniter and at least a part of the pilot line, with the former preferably stationary and the latter movable with respect thereto and the plural burners.

It is an additional object of the present invention to provide a rotating pilot gas tube, with an electric igniter and plural gas burners adjacent in spaced relation to the circular path of the outer end of the tube, so that a pilot flow of gas issuing at such end is electrically ignited and effective as it rotates to ignite burners to which gaseous fuel is being selectively delivered.

Still further objects are providing individually and in combination a rotating gas pilot tube, an electrical igniter, and mechanical and electrical controls for the same, including control means whereby actuation of any gas burner valve in the top causes energization of the igniter, rotation of the pilot tube, and the supply of the gas to the pilot tube and the burner served by the valve.

In overall assembly, it is also an object of this invention to provide a cook top of the foregoing characteristics, in which the burners, their gas supply tubes and the rotating pilot are suspended from the top cover within a rough-in box that is substantially entirely free of obstructive devices for easy cleaning of the interior when the top is lifted, for example, to a propped open position.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

In said annexed drawings:

FIG. 1 is a top view of a gas cook top in accordance with the invention, with the cover thereof partially removed to expose elements beneath the same;

FIGS. 2 and 3 are transverse sectional views respectively at the planes 2—2 and 3—3 in FIG. 1;

FIG. 4 is a section of the rotating pilot assembly;

FIG. 5 is a section at the plane 5—5 in FIG. 3 showing a mechanical slide control operatively associated with the pilot;

FIG. 11 is a partially broken elevation of the cook top as installed in a kitchen range, with the top cover in lifted open condition for cleaning of the interior.

Figure 9:
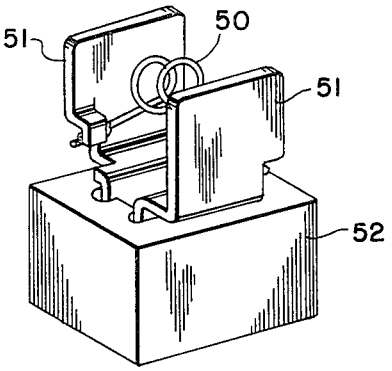
FIG. 9 is a perspective view of the glow coil component of the igniter.

Referring now to the drawings in detail, the illustrated gas cook top assembly comprises a rectangular, relatively shallow box 10 of sheet metal open at its top and a separately formed cover or top 11 for the box with a suitably finished upper surface. The cover is provided with four circular burner openings arranged in corresponding pairs at the respective sides and, in each of these, there is suspended an apertured drip pan 12, with a cast grate 13 supported on the cover in bridging relation to each pan, the pans and grates being conventional in form and function.

As will be discussed further below, this particular top is designed to form the upper, surface cooking part of a free-standing range, designated generally by reference numeral 14, and, accordingly, it is provided with a top burner control module 15 at the front of the box. Such module has, for greater convenience, a rearwardly sloped front wall 16 in which four burner control valves, with knobs 17, are mounted. The valves are thus held at a downward inclination and extend into the front of the box proper, as shown most clearly in FIGS. 2 and 3, where they have their inlets commonly connected to a burner gas supply manifold 18 that extends along the box front and is, in turn, connected to a fuel pipe 19 that continues to the rear of the box adjacent one side for connection to an exterior line, not shown, from the gas source utilized.

Each valve has an axial outlet spud 20 extending into an end Venturi section 21 of a burner gas pipe 22. The burner gas pipes or tubes lead respectively to four burners 23 of known annular orifice type positioned within the apertures of the drip pans and spaced, as usual, a predetermined distance below the grates. The valves thus through actuation of the knobs 17 individually and selectively regulate the flow of the gaseous fuel to the burners 23, with air drawn into the ends of the Venturi sections 21 for mixing therein with the fuel, again in conventional manner.

However, it is important to note that the burners, and their supply tubes, are not supported by the bottom or other interior structure of the box, but rather by a flanged metal partition or wall 24 that is secured at front and rear flanged portions to the underside of the cover. This partition is downwardly offset by virtue of its such flanging, and extends over the central rectangular area of the cover in such spaced relation to the same.

More particularly, each pair of burners 23 is supported on an underlying support rod 25 of U-shape, the two rods having their ends removably inserted through slotted brackets 26 and against stops 27 on the partition. The specific form of this attachment is not critical, but it is preferred that it provide removal of the rods so that, when access to the underside of the cover is had, each pair of burners on their common support rod can be detached as desired for close inspection, possible replacement and the like.

From what has been said, it will be appreciated that removal or relative lifting of the cover from the box is contemplated and, further, that such relative movement must be accommodated in the supply of gas to the burners. This is provided in the preferred embodiment shown by radially slotting the ends of the Venturi tube sections 21 at the bottoms of the same so that they removably fit over the valve spuds, the other ends of the supply pipes or tubes being fixedly connected to the respective burners. The pipes 22 thus move with the top cover upon lifting of the same, for example, as shown in FIG. 11, and it will be understood that some suitable form of interlock, not shown, should preferably be provided to effectively disable the valves whenever the gas connections are opened by lifting of the cover.

Selective ignition of the gas burners is accomplished by a flame ignition system having as its principal components an igniter assembly designated generally by reference numeral 28 and a rotating pilot assembly designated again generally by reference numeral 29. Both assemblies are mounted on the partition 24 in the space between the cover and the partition, with the former at a forward central location just behind the front flange or wall 30 of the cover and the latter at the center of the rectangle defined by the vertical axes of the four burners 23.

Figure 7:
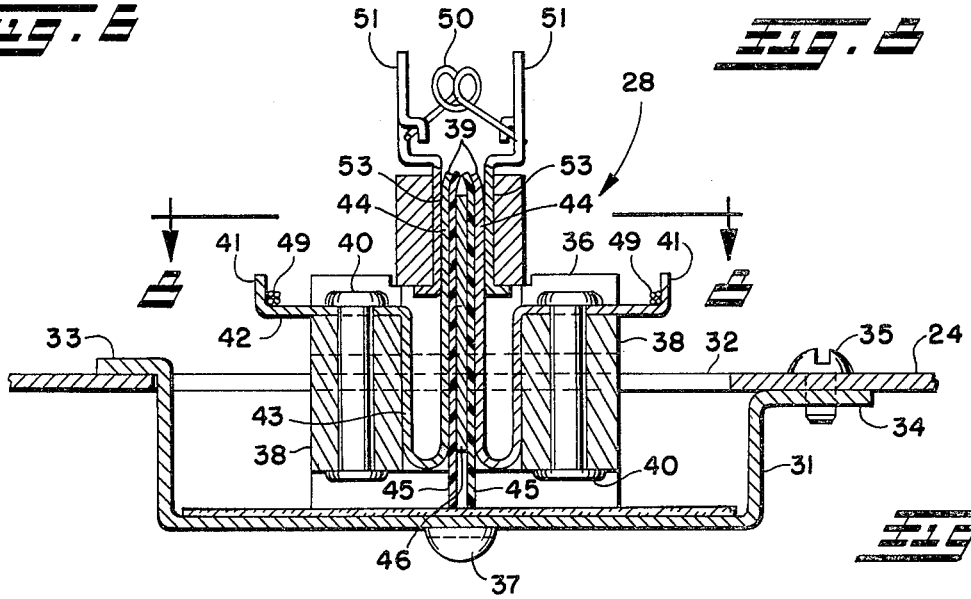
FIG. 7 is a section of the igniter taken at line 7—7 in FIG. 6.

With particular reference to FIGS. 6–10 of the drawings, the igniter assembly 28 is supported on a strap-like flanged base 31 that extends across a rectangular opening 32 in the partition 24, the igniter assembly being partially within the opening due to downward offset of the base from its end flanges, as shown most clearly in FIG. 7. As also evident from this figure, one base end flange 33 rests on the partition, while the other end flange 34 is removably fastened at the underside of the partition by a screw 35. The base and hence the igniter assembly mounted thereon can therefore be separately detached, which is also obviously advantageous from a maintenance standpoint and the like.

Figure 10:
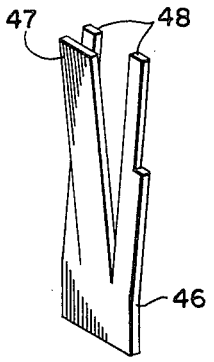
FIG. 10 is a detail perspective of an electric blade contact used in the igniter.
Figure 6:
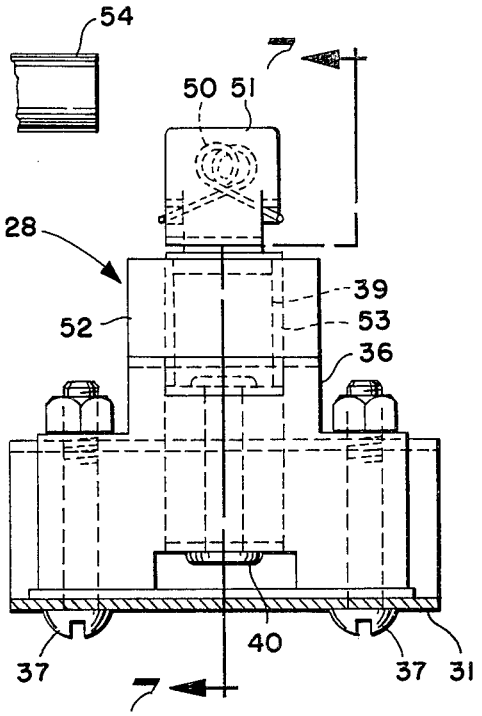
FIG. 6 is an elevation of an electric igniter according to the invention.
Figure 8:
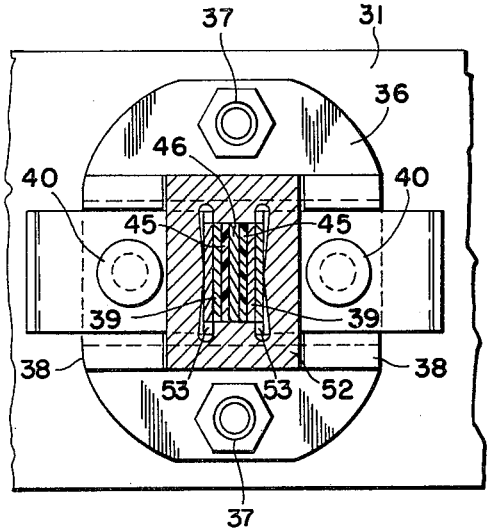
FIG. 8 is a further right angle section of the igniter indicated by line 8—8 in FIG. 7.

The mounting of the igniter assembly includes an insulative stand 36 with flanges bolted at 37 to the base 31 and having elevated block sections 38 of solid metal in spaced opposition. Two identical contact blades 39 are fastened by rivets 40 to the sections 38, with each blade having an outer end flange 41, a shoulder 42 overlying the top of one of the sections 38 and there fastened by one of the rivets 40, a portion 43 overlying the inner face of the supportive block section, and a long rebent vertical portion 44 that also projects freely above the block section. These free ends of the two blades 39 are in relatively close spaced opposition and are resilient. Strips of silicon glass 45 or other electric insulation are applied to the opposed surfaces of the blades to insure their electrical separation, and a spring 46, shown separately in FIG. 10, is closely interposed between the two.

The spring 46 is flat with a tongue 47 and resiliently deformable and normally angularly offset fingers 48 at the sides of the tongue. The normal shape is shown in FIG. 10, while the operative compressed condition of the spring between and, therefore, exerting outward pressure on the blade contacts 39, is shown in FIG. 7. Two electrical leads or wires 49 are conductively connected respectively to the contacts, for example, by soldering, within their outer flanged corners, and these leads will be connected to receive from the range wiring, not shown, energy at a suitably stepped-down voltage, the structure thus far detailed constituting an electrical male connector.

The igniter assembly is completed by a separate and removable female connector including an igniter coil 50 of wire of such resistance material that it will become substantially instantaneously incandescent when energized as set forth. Such glow coils for electric ignition of gas burners and the like are known and readily available, with the coil here having its ends respectively secured to opposed metal pieces 51 that serve both as shields for the coil and electrical contacts. The upper parts of these pieces are of larger area than the coil ends and, with the coil between the same, it is protected, for example, against being accidentally struck in assembling or servicing the cook top. The combination shield/contacts extend downwardly through an apertured electrically insulative block 52 to which they are secured, so that there are within the aperture spaced flat contact surfaces 53 for detachable plug-in engagement with the above-described stationary prongs or blades 39. The latter have substantial physical contact with the metal block sections 38, so that these sections act as heat sinks for absorption of unwanted heat at the end connections of the coil 50.

Accordingly, the electric igniter assembly 28 establishes when energized an incandescent or glow coil at the front center of the cook top, and a plastic sight tube 54 is mounted in the front cover flange 30 with its inner end adjacent the coil so that there is an automatic light signal of the coil energization for the user of the cook top. The coil operating temperature will of course be more than adequate to provide ignition of the gas fuel to be used in the top, and such ignition here ignites a small or pilot stream of the gas issuing from the rotating pilot assembly.

The pilot assembly 29, with particular reference to FIGS. 3 and 4, comprises a cylindrical pivot or head 55 made of a plastic, such as nylon, having bearing capacity, the lower end of the head resting on the upper surface of the partition 24 and turning freely on the same. This head has an axial bore 56 closed at the upper end and communicating adjacent the latter with a radial outlet passage 57. A small diameter pilot gas tube 58 is fitted in such passage and extends radially from the head a predetermined distance, with its outer end portion having a downwardly bent section 59 and the lower radial continuation 60 open at the tube end. When rotated, the open outer end of tube 58 moves in a circular path in a horizontal plane in the space between the partition and the top cover. This plane, as shown in FIGS. 1 and 2, is substantially that of the igniter glow coil 50 and the orifices of the four burners 23, these elements at spaced points proximate to the path of rotation of the pilot tube.

The pilot head 55 is formed with an intermediate integral rib or boss 61 having a continuous slot in its outermost surface, so that an elastic pulley band 62 can be engaged in the slot to rotatably drive the head.

The head is positioned over a circular hole in the partition 24 of the same diameter as the head bore 56, and projecting through such hole and almost fully into the bore is a plastic pivot post 63 that is itself provided with a smaller axial through passage 64. The post has a circular bottom enlargement 65 abutted against the underside of the partition 24, the post providing the mounting of the head for rotation in stable manner. The enlargement to the side of the center passage 64 through the same is formed with a stepped passage 66 in register with a hole in the partition, and a pilot gas line 67 extends from a remote source connection through the hole and into the passage where its flanged end engages the step. Suitable sealing material is applied exteriorly about the thus received end of the line, and the bottom of the enlargement 65 where the passage 66 exits is relatively relieved between outer and inner ribs 68 and 69 downwardly projecting to the same extent and being annular and continuous. A flexible, gas impermeable diaphragm 70 is applied against such bottom of the enlargement with a circumferential bead 71 just outboard of the rib 68 and a thickened center part 72 against the inner rib 69, thereby normally closing the post passage 64 against communication with the noted space between the ribs 68, 69 and hence the pilot gas line 67 leading to the latter. The diaphragm is held in this disposition by an inverted domed cap 73 attached at its outer flange to the partition 24 at its underside by fasteners, such as screw 74, and the cap has a central aperture 75 through which the thickened center part 72 of the diaphragm is freely movable, the cap otherwise bearing against the diaphragm to hold it in place against the post bottom enlargement.

The diaphragm 70 in such coaction with the bottom configuration of the pivot post forms a normally closed pilot gas valve to regulate the flow of gas from the supply line 67 to the rotatable pilot tube 58, and actuator mechanism for such valve includes a flat section arm 76 that is also in radial extending relation to the pilot assembly. The horizontal inner end section 77 of this arm carries a vertical adjusting screw 78 threadably engaged with a nut 79 at the underside of the arm, the upper end of the screw bearing against the center part 72 of the diaphragm. The arm, proceeding outwardly from the noted end section, is bent at 80 upwardly at an angle to pass through an opening 81 in the partition 24 adjacent which there is an upwardly struck and top slotted pivot holder 82 for the arm. Above the partition, the arm is again horizontal as it is seated in the pivot holder 82 and extends forwardly through another upwardly struck plate 83 to a forward end finger 84 of reduced width (FIG. 1).

An electrical switch 85, to be used for a purpose to be described, is mounted on the plate 83 and has a depending operating plunger 86 resting at its bottom on the arm 76 within a coil spring 87 that provides a downwardly directed pressure on the arm. The arm, as a result, pivots at the holder 82 between the spring 87 and the adjusting screw end 77 engaged with the diaphragm 70. The forward end finger 84 of the arm is positioned over a slide bar assembly 88 and, more particularly, against a lifter angle 89 projecting above the top edge of the slide bar 90 in this assembly.

The bar, with reference to FIG. 5, is mounted on the stems 91 of the gas valves in such manner that the stems support the bar for relative angular translation against a spring 92 tensioned between the bar and the bottom of the rough-in box 10. The two outermost valve stems thus pass through 45° slots 93 in the bar, while the valve stems of the two inner valves extend freely through clearance holes 94 in the bar of a diameter to accommodate the relative movement of the bar on the valve stems guided in the outermost slots. Each valve stem just in front of the bar has a flatted cam 95 fixed on the same with its flat cam surface engaged against a vertical stationary cam angle 96 attached to the front of the bar.

The gas valves are such that opening is caused by knob and stem rotation in a clockwise direction, and, whenever any stem 91 is so turned, the cam 95 on the same pushes against the angle 96 engaged thereby to cause the slide bar to move from the full line position shown in FIG. 5 to the partially shown broken line position or, in other words, angularly upward to the right in this view. The translation is of course controlled by the action of the outermost stems in the angular slots 93 regardless of which valve may be operated or actuated, and the lifter 89 at the top, preferably at an angle of about 30° from the horizontal, executes a similar movement.

Such movement of arm 76 causes switch 85 to be actuated, in this case from a normally open to a closed condition, and also pivots the arm to depress its inner end 7 and thereby permit the diaphragm 70 to flex outwardly and open the pilot pivot post passage 64 for admittance of the pilot gas flow. The switch is in series connection with an electric drive motor 97 for the rotatable pilot head 55, with this motor shown in FIGS. 1 and 2 as suitably mounted within the range 14 at the lower rear of the cook top. The motor output shaft 98 extends vertically through a nylon bearing block 99 and has a drive pulley 100 secured on its upper end portion. This pulley is connected to the pulley form 61 on the pilot head by the above-mentioned elastic drive band 62, so that the motor is effective when energized to rotatably drive the head and therefore rotate the pilot gas tube 58 with its outer and describing the circular path illustrated by the broken arrow in FIG. 1.

Accordingly, when the cook top is completely inoperative, with no burner in use or selected for use, the entire ignition system, including the igniter and the rotating pilot assembly, is in a de-energized, non-active state. When an operator of the range turns on any burner 23 by rotating its control knob 17, the slide bar 90 is cammed generally upwardly as disclosed and the actuator arm 76 raised both to close the electrical switch 85 and open the pilot valve. Such switch closure energizes both the igniter coil 50 and the pilot head drive motor 97, the latter being effective to rotate the pilot tube at its outer end at a speed of about thirty rpm to ensure burner ignition within 4 seconds. The first time the pilot tube 58, with the gas issuing from the same, is thus rotated past the energized glow coil 50, such gas is ignited and a pilot flame now at the end of the tube is swept successively by the orifices of the several burners to ignite that burner receiving the gaseous fuel mixture as a result of the turning on of its valve. The operator will have a signal that the igniter is functioning at the sight tube 54, and, if such signal is not obtained, then it will be immediately known that the igniter has not been properly energized for one reason or another.

Additional burners can, of course, be turned on and will be similarly ignited, the ignition system remaining activated as long as a single burner is in the "on" condition. When the last burner is turned off, the slide bar 90 returns to its rest position by virtue of the spring 92, and spring 87 acting on the actuator arm 76 causes the arm to pivot to follow such movement, opening the switch 85 and closing the pilot valve. The switch opening de-energizes the igniter and pilot drive motor.

The facility of cleaning the interior of the cook top has been mentioned earlier in connection with the desired removability of the cover from the rough-in box, and one manner in which this can be effected is shown in FIG. 11. The cover is there shown as connected at its back edge to the backguard 101 of the range by a hinge 102, and beneath the two front corners of the cover there are depending prop rods 103 that are received in side spaces within the range when the cover is in its usual closed condition. As the cover is raised at the front, these rods are withdrawn until shoulders 104 in the lower ends of the same are clear and snap forwardly as a result of spring tension in the rods to seat on stationary range structure adjacent the openings for the rods. The top is thus propped open as shown in FIG. 11, providing easy access to the walls and the bottom in particular of the rough-in box for cleaning, especially since all of the burners, the igniter assembly, the rotating pilot assembly, and other devices within the ignition system more with the cover. With the drive motor for the pilot assembly located outside of the box as described, it will be appreciated that the elastic band connecting the same to the pilot head can deform to accommodate this relative movement of the two without disconnection.

It will, accordingly, be clear that the cook top ignition system disclosed provides use activated ignition in a multiple burner array with a single electric igniter. The rotating pilot, in effect, transfers ignition from the single electric igniter to one or more of the burners in the array as selected for use, the ignition thereby being a two step procedure in which proper igniter activation, or lack of the same, is visually signalled to the user. Should the glow coil sustain damage or disabling deterioration, its plug configuration permits it to be readily replaced. Removal of the burners is also readily had, and the disclosed construction otherwise fully meets the first noted objectives of the invention.

The safety interlock earlier mentioned, precluding or terminating burner operation upon lifting of the cover, could be accomplished by a lock acting on the valve slide bar; a pivotal manifold coupling might also serve the purpose, wherein raising the cover pivots the manifold and such action shuts off the main gas supply.

It is also significant to note that the rotation of the pilot arm promotes a tendency to expel the pilot gas by centrifugal action. The fact that the pilot flame actually brushes over the burner ports as it rotates importantly provides low turn on ignition, for example, as compared to a conventional flash tube and stationary pilot in which the burner must be turned to a high on setting (for ignition) before adjustment to a low or simmer setting.

I, therefore, particularly point out and distinctly claim as my invention:

1. A cook top comprising a plurality of gas burners, an electric igniter for the plural burners, movable pilot light means, and drive means for moving the pilot light means relative to the igniter and the gas burners such that the pilot light means is lit by the igniter and the latter brought into ignition proximity to the respective burners to ignite any turned on.

2. A cook top as set forth in claim 1, wherein the drive means includes an electric motor, and the igniter and said motor are energized in response to user selection of a gas burner for operation.

3. A cook top as set forth in claim 2, including pilot valve means for controlling flow of gas to the pilot light means, said pilot valve means being normally closed and opened in response to the burner selection for operation.

4. A cook top as set forth in claim 3, wherein the drive means rotates the pilot light means, the igniter and the burners being spaced adjacent the path of rotation of the pilot light means for lighting the same and for burner ignition.

5. A cook top as set forth in claim 1, wherein the drive means rotates the pilot light means, the igniter and the burners being spaced adjacent the path of rotation of the pilot light means for lighting the same and for burner ignition.

6. A cook top as set forth in claim 1, wherein the drive means moves the pilot light means successively and repetitiously into such proximity to the igniter and the gas burners.

7. A cook top as set forth in claim 6, including switch means for controlling energization of the igniter and actuation of the drive means, the gas burners being manually turned on and off, and actuator means for operating said switch means to activate and de-activate the igniter and drive means coincident with such on-off burner control.

8. A cook top as set forth in claim 6, wherein the plural gas burners have individually operative manual controls determining their respective on and off conditions, and ignition control means is provided including means for energizing the igniter and actuating the drive means whenever any burner is in its on condition.

9. A cook top as set forth in claim 8, wherein the ignition control means includes an interlock between the burner controls and, in common, the igniter and drive means to provide such energization and actuation of the same.

10. A gas cook top, comprising plural burners with individual control valves for selective operation thereof, said burners having ignition sections that are spaced on an arc, common igniter means for the burners at a further location adjacent the same arc, a pilot device having a flame port, drive means for rotating the pilot device so that such port moves in a circular path including said arc, and pilot valve means for controllably supplying gas to the rotating pilot device, whereby the pilot can be lit by the igniter means and in turn light any burner that is turned on.

11. A gas cook top as set forth in claim 10, wherein the pilot valve means and the drive means are controlled in response to burner operation, such valve means being normally closed and opened when any burner is turned on and the drive means being normally quiescent and operative likewise when any burner is in on condition.

12. A gas cook top as set forth in claim 11, wherein such control of the pilot valve means includes an actuator and mechanism connected to the burner control valves for moving said actuator to effect opening and closing of the pilot valve means responsive to operation of the latter.

13. A gas cook top as set forth in claim 12, wherein said mechanism includes a slide bar common to the plural burner valves and translated by operation of any one of them to on condition to move the actuator to open the pilot valve means and hold the same open as long as there is one burner valve turned on.

14. A gas cook top as set forth in claim 13, wherein the drive means is controlled by electrical switch means also actuated by said slide bar, so that rotation of the pilot is similarly responsive to burner valve operation.

15. A gas cook top as set forth in claim 14, wherein the igniter means is electric.

16. A gas cook top as set forth in claim 15, wherein electrical energization of the igniter means is controlled by said switch means and likewise responsive to burner valve operation.

17. A gas cook top as set forth in claim 10, wherein the igniter means is electric.

18. A gas cook top as set forth in claim 17, including control means for electrically energizing and deenergizing the igniter means in response to burner control valve operation such that the igniter means is energized when any burner is turned on and will remain energized until the last on burner is turned off.

19. A gas cook top as set forth in claim 18, wherein the igniter means includes a glow coil ignition element.

20. A gas cook top as set forth in claim 19, including signal means for transmitting incandescence of said coil to an exterior viewer of the cook top.

21. A gas cook top assembly comprising a plurality of burners, a single pilot tube for lighting said burners, a pivot head from which the tube extends at one end, stationary support means for mounting the head for rotation to bring the outer end of the tube successively into ignition proximity to the burners, drive means for thus rotating the head, and means defining a passageway through the support means for flow of gas from a source to the tube and establishment of a pilot flame at its outer end.

22. A gas cook top assembly as set forth in claim 21, including pilot gas valve means in said passageway to control issuance of the gas from the pilot tube.

23. A gas cook top assembly as set forth in claim 22, including actuator means for said pilot valve means operated in response to on and off adjustment of the burners, the pilot valve means being normally closed and opened by the actuator whenever any burner is turned on.

24. A gas cook top assembly as set forth in claim 21, including control means for operating said drive means in response to burner operation, the drive means being normally at rest and operative when any burner is in on condition.

25. A gas cook top assembly as set forth in claim 24, including actuator means for said pilot valve means operated in response to on and off adjustment of the burners, the pilot valve means being normally closed and opened by the actuator whenever any burner is turned on.

26. A gas cook top assembly as set forth in claim 25, including control means for operating said drive means in response to burner operation, the drive means being normally at rest and operative when any burner is in on condition.

27. A top gas cooking assembly, comprising a roughin box, a cover for said box having plural burner openings therein, a partition secured to the underside of the cover and held in downwardly spaced relation to the same, gas burners supported on said partition and respectively disposed in the cover openings, electric igniter means on the partition and within the space between the cover and the partition, and pilot means similarly located and having a gas tube with a pilot light end rotatable successively by the igniter means and the plural burners, so that the tube can be lit by the igniter means and in turn light the burners.

28. A top gas cooking assembly as set forth in claim 27, wherein the cover is separate from the box and can be raised to an open position in which the box interior is exposed for cleaning, the partition and hence the burners, igniter means, and pilot means moving with the cover.

* * * * *